US005781839A

United States Patent [19]

Kikui

[11] Patent Number: 5,781,839

[45] Date of Patent: Jul. 14, 1998

[54] MULTICOLOR IMAGE FORMING APPARATUS

[75] Inventor: Shinsuke Kikui, Kawasaki, Japan

[73] Assignee: Ricoh Company, Ltd., Tokyo, Japan

[21] Appl. No.: 811,950

[22] Filed: Mar. 5, 1997

[30] Foreign Application Priority Data

| | | | |
|---|---|---|---|
| Mar. 5, 1996 | [JP] | Japan | 8-073050 |
| Jul. 15, 1996 | [JP] | Japan | 8-185044 |
| Jan. 10, 1997 | [JP] | Japan | 9-003159 |

[51] Int. Cl.[6] ..... G03G 15/16

[52] U.S. Cl. ..... 399/296; 399/66; 399/298

[58] Field of Search ..... 399/45, 50, 53, 399/54, 55, 38, 46, 223, 228, 298, 296, 66

[56] References Cited

U.S. PATENT DOCUMENTS

| | | | |
|---|---|---|---|
| 4,860,048 | 8/1989 | Itoh et al. | 399/40 |
| 5,063,127 | 11/1991 | Oka et al. | 430/45 |
| 5,258,820 | 11/1993 | Tabb | 399/296 |
| 5,450,172 | 9/1995 | Suzuki et al. | 399/223 |
| 5,557,392 | 9/1996 | Iwata | 399/223 |
| 5,579,100 | 11/1996 | Yu et al. | 399/39 |
| 5,581,330 | 12/1996 | Pietrowski et al. | 399/171 |
| 5,600,430 | 2/1997 | Folkins et al. | 399/171 |
| 5,666,612 | 9/1997 | Beachner et al. | 399/223 |

FOREIGN PATENT DOCUMENTS

| | | |
|---|---|---|
| 58-108555 | 6/1983 | Japan . |
| 4-352183 | 12/1992 | Japan . |
| 8-015941 | 1/1996 | Japan . |

*Primary Examiner*—Matthew S. Smith

*Attorney, Agent, or Firm*—Oblon, Spivak, McClelland, Maier & Neustadt, P.C.

[57] ABSTRACT

A multicolor image forming apparatus of the present invention includes a first image forming condition controller for reducing the amount of toner to deposit on a photoconductive element, and therefore the amount of toner to deposit on character images. This reduces the fall of a transfer electric field ascribable to a toner layer. After an upstream image forming devices with respect to the direction of rotation of the photoconductive element has formed a toner image on the element, a second image forming condition controller again charges the toner image before transfer by use of a charger included in a downstream image forming device. This increases the amount of charge to deposit on the toner image without resorting to any extra device. A third image forming condition controller means increases a voltage or a current to be applied to a contact type transfer device, thereby enhancing desirable transfer of the toner image. The first to third controllers are selectively executed to obviate the vermicular omission of images without resorting to any extra device.

19 Claims, 5 Drawing Sheets

Fig. 2

| | 55K SHEET | 135K SHEET | POSTCARD |
|---|---|---|---|
| 2ND CHARGER 20 OFF | ○ | × | × |
| 2ND CHARGER 20 ON<br>GRID POTENTIAL −900V | ○ | ○ | △ |
| 2ND CHARGER 20 ON<br>GRID POTENTIAL −1050V | ○ | ○ | ○ |

MULTICOLOR IMAGE FORMING APPARATUS

BACKGROUND OF THE INVENTION

1. Field of the Invention

The present invention relates to a multicolor image forming apparatus of the type selectively forming a bicolor image or a monocolor image on a photoconductive element, and transferring the toner image to a recording medium by a contact type transfer device.

2. Discussion of the Background

It is a common practice with an image forming apparatus of the type described to press a sheet or similar recording medium against a photoconductive element with a transfer device in the form of a belt or a roller. The problem with this kind of image transfer system is that a cohesive force acting between toner particles increases at an image transfer position, causing the central portion of a character image to be lost in the form of vermiculation. Another cause of such vermicular omission of an image is the fall of a transfer electric field ascribable to the thickness of the sheet itself. Therefore, the vermicular omission is apt to occur particularly when thick sheets, OHP (Over Head Projector) sheets, postcards and so forth are used.

To obviate the vermicular omission of an image, a voltage to be applied to a contact type transfer device may be increased. However, this voltage cannot be increased beyond a certain limit because an excessively high voltage causes defective image transfer to occur over a broad area due to discharge at the inlet of the transfer position and leakage, resulting in another defective image locally omitted over a substantial area. Let this kind of omission be referred to as massive omission, as distinguished from the vermicular omission.

On the other hand, in an image forming apparatus using a corona transfer system, a toner image formed on a photoconductive element may be again charged, or recharged, before transfer to a recording medium, as taught in, e.g., Japanese Patent Laid-Open Publication Nos. 57-82862 and 63-292164. While this kind of scheme obviates the vermicular omission of images, it is not practicable without resorting to an exclusive charger which increases the cost. Such a recharging scheme may be applied to the apparatus using the contact type transfer system, as disclosed in Japanese Patent Laid-Open Publication No. 3-102382 by way of example. This, however, also needs an exclusive charger and thereby increases the cost.

An image forming apparatus having two sets of image forming means each consisting of the respective charger, exposing unit and developing unit and capable of forming a bicolor image is also conventional. In this type of device, when one of the two image forming means forms a monocolor image, the charger of the other image forming means may be used to charge a toner image formed on a photoconductive element, as proposed in Japanese Patent Laid-Open Publication No. 4-2179 by way of example. The technology taught in this document enhances the transfer efficiency of the corona transfer system by depositing a charge opposite in polarity to the toner image in order to reduce the amount of charge of the toner image. Therefore, such a technology would aggravate the vermicular omission of images if applied to the contact transfer type apparatus.

Further, a charge potential and a bias for development may be varied in order to increase the reproducibility of line images and solid images, as taught in, e.g., Japanese Patent Laid-Open Publication No. 2-173684. This kind of scheme increases the difference between the charge potential and the potential of the exposed portion of a line image so as to prevent lines from being thickened. However, because the amount of toner for development increases due to the effect of an edge electric field, the vermicular omission of images is apt to occur.

SUMMARY OF THE INVENTION

It is therefore an object of the present invention to provide a multicolor image forming apparatus capable of obviating the vermicular omission of images with a simple construction without resorting to any extra device.

In accordance with the present invention, an image forming apparatus includes a plurality of chargers sequentially arranged in the direction of rotation of a photoconductive element, each for charging the photoconductive element. A plurality of developing units are sequentially arranged in the above direction, each for forming a toner image of particular color on the photoconductive element. A contact type transfer device transfers the toner image from the photoconductive element to a recording medium. A controller selectively operates the chargers and developing units to thereby form either a monocolor toner image or a multicolor toner image on the photoconductive element. When the monocolor toner image is to be formed, the controller causes downstream one of the chargers in the above direction to recharge, before transfer by the transfer device, the toner image formed by upstream one of the chargers in the above direction and upstream one of the developing units.

In a preferred embodiment the controller has a first image forming condition control means for reducing the amount of toner for development, and second image forming condition control means for causing, before transfer by the transfer device, the downstream charger to recharge a toner image formed by the upstream charger and upstream developing unit. When the monocolor toner image is to be formed, the first and second image forming condition control means are selectively executed.

BRIEF DESCRIPTION OF THE DRAWINGS

The above and other objects, features and advantages of the present invention will become apparent from the following detailed description taken with the accompanying drawings in which:

FIG. 2 lists the results of evaluation as to the local omission of an image and effected with different kinds of sheets;

DESCRIPTION OF THE PREFERRED EMBODIMENTS

Figure 1:
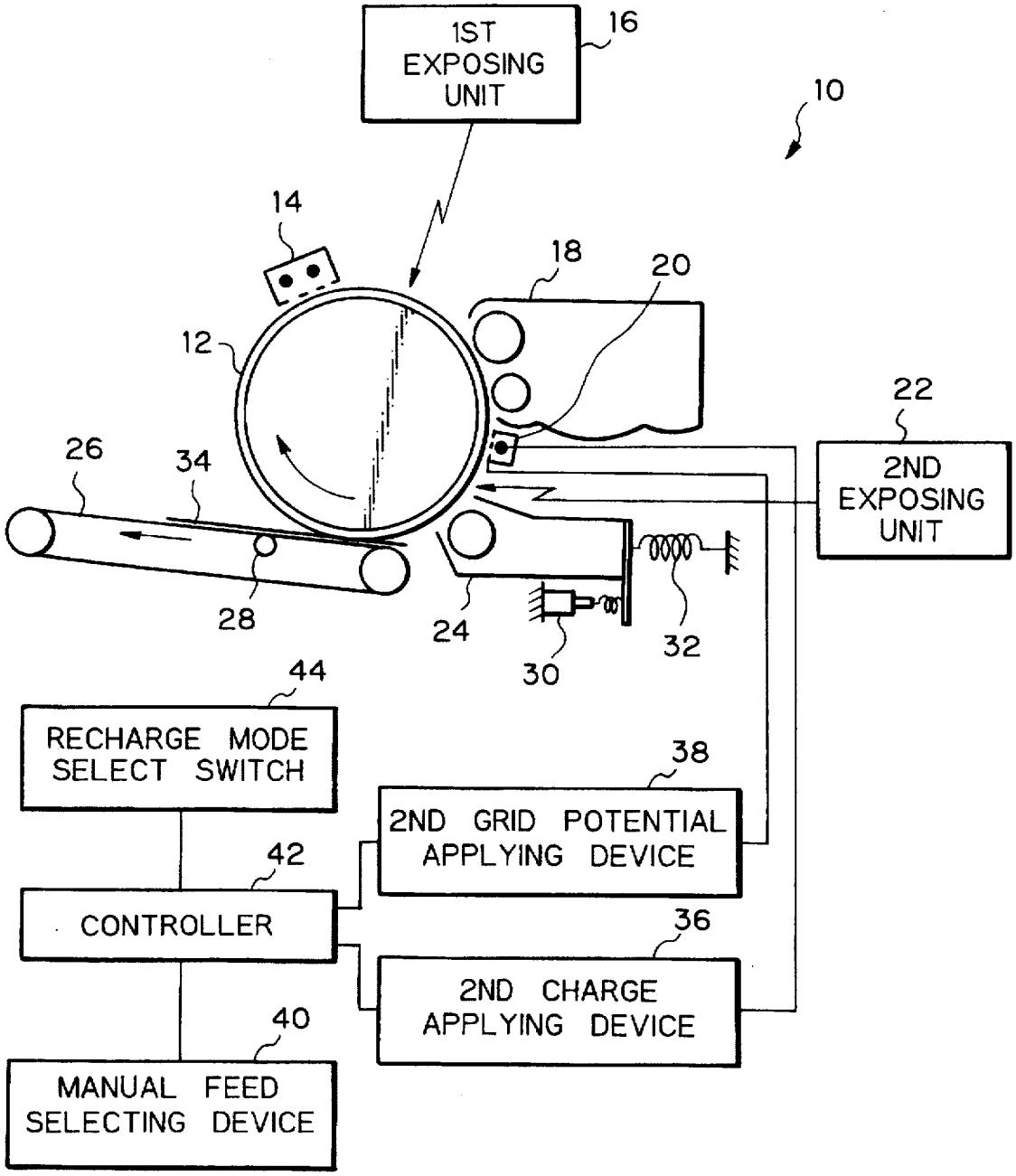
FIG. 1 shows a multicolor image forming apparatus embodying the present invention.

Referring to FIG. 1 of the drawings, a multicolor image forming apparatus embodying the present invention is shown and generally designated by the reference numeral 10. As shown, the apparatus 10 includes a photoconductive element in the form of a drum 12 rotatable clockwise. A first charger 14 charges the surface of the drum 12. A first exposing unit 16 exposes the charged surface of the drum 12. A first developing unit 18 develops a latent image formed on the drum 12 by the exposing unit 16. These constituents 14–18 are sequentially arranged at the upstream side with respect to the direction of rotation of the drum 12. A second charger 20 for charging the drum 12, a second exposing unit 22 for exposing the charged surface of the drum 12, and a second developing unit 24 for developing a latent image formed on the drum 12 are sequentially arranged at the downstream side with respect to the above direction. A belt transfer device 26 is located downstream of the second developing unit 24 and includes a bias roller 28. The first and second developing units 18 and 24 store, e.g., black toner and red toner, respectively. Only when a latent image should be developed in red, the developing unit 24 is moved to a position close to the drum 12 by a solenoid 30. The developing unit 24 is usually biased away from the drum 12 by a spring 32.

The apparatus 10 produces a bicolor image, as follows. The first charger 14 charges the surface of the drum 12 uniformly. The first exposing unit 16 scans the charged surface of the drum 12 with a laser beam in order to form a negative-to-positive latent image. The first developing unit 18 develops the latent image with the black toner and thereby produces a black or first toner image. Subsequently, the second charger 20 again charges, or recharges, the entire surface of the drum 12 including the black toner image area. Then, the second exposing unit 22 scans the surface of the drum 12 with a laser beam in order to form a negative-to-positive latent image. The second developing unit 24 develops the latent image with the red toner and thereby forms a red or second toner image. The resulting black-and-red bicolor image is transferred to a sheet 34 by the belt transfer device 26 to which a voltage is applied via the bias roller 28.

The prerequisite with the second charger 20 is that it prevents the red toner from being mixed with the black toner image and prevents the black toner from entering the second developing unit 24. For this purpose, the charging conditions of the charger 20 are determined by a second charge applying device 36 and a second grid potential applying device 38. For example, assume that the black toner image is formed by a potential of −850 V applied to the first charger 14, a potential of −100 V applied to the first exposing unit 16, and a bias voltage of −550 V applied to the first developing unit 18. Then, when the bias voltage of the second developing device 24 is −750 V, the second charger 20 meets the above requirement, as determined by experiments. Further, the second charge applying device 36 causes the second charger 20 to deposit a charge of −800 V to −900 V on the black toner image portion of the drum 12. In addition, the second grid potential applying device 38 applies a second grid potential of −900 V to the second charger 20. The potential of the second exposing unit 22 is selected to be −100 V.

Assume that the apparatus 10 having the bicolor image forming capability produces a monocolor image, e.g., black toner image. Then, usually, the second charger 20, second exposing unit 22 and second developing unit 24 are held inoperative while the black toner image is produced. Only when the manual feed of the sheet 34 is selected on a manual feed selecting device 40, the second charger 20 is rendered operative for the following reason. Generally, when the belt transfer device 26 or similar contact type image transfer device is used, it presses the sheet 34 against the drum 12. This increases the cohesive force acting between the toner particles and thereby causes the central portion of a character image to be lost in the form of vermiculation. The vermicular omission of an image is particularly conspicuous when use is made of, e.g., thick sheets. Because thick sheets, for example, can be fed only by hand, the second charger 20 is driven at the time of manual feed in order to obviate the vermicular omission.

FIG. 2 lists experimental results relating to the above vermicular omission of an image. For the experiments, monocolor images were formed in black on 55K plain papers, 135K thick papers, and postcards. As shown, when the second charger 20 is not driven, images formed on the 55K plain papers are free from the vermicular omission while images formed on the 135K thick papers and postcards suffer from the vermicular omission. On the other hand, when the charger 20 is driven and a grid potential of −900 V is set up, images formed on the 55K plain papers and 135K thick papers are free from the vermicular omission while images formed on the postcards are slightly omitted. Further, when the grid potential is −1,050 V, all the images formed on the 55K papers, 135K papers and postcards are free from the vermicular omission.

In light of the above, a grid potential of −900 V and a grid potential of −1,000 V for forming a black-and-red image and a monocolor image, respectively are set in the second grid potential applying means 38 beforehand. When the operator of the apparatus selects a monocolor mode and selects manual feed on the manual feed selecting device 40, a controller 42, FIG. 1, causes the second charge applying device 36 to output its preselected charge potential and causes the second grid potential applying device 38 to output the grid potential of −1,000 V. The outputs of the two devices 36 and 38 are applied to the second charger 20. This successfully increases the image transferring force and thereby obviates the vermicular omission of images. In this case, because the second developing unit 24 is spaced from the drum 12, the entry of the black toner in the developing unit 24 does not occur. In addition, because the second charger 20 is not driven when plain papers are conveyed along a sheet transport path for image formation, the apparatus 10 consumes a minimum of power and produces a minimum of ozone.

While the above embodiment drives the second charger 20 only when the monocolor mode and manual feed mode are selected, a recharge mode select switch 44 may be provided on an operation panel. In such a case, the second charger 20 will operate also when the recharge mode select switch 44 is operated. This kind of arrangement allows the operator to drive the second charger 20 any time and thereby enhances easy operation, while insuring high image quality.

In the illustrative embodiment, the black toner stored in the first or upstream developing unit 18 has a degree of cohesion as high as, e.g., 20% to 25% while the red toner stored in the second or downstream developing unit 24 has a degree of cohesion as low as, e.g., 5% to 10%. Then, monocolor images formed in red on the 55K papers, 135K papers and postcards are free from the vermicular omission omission even when the recharging preceding the transfer is not effected. This is because the low degree of cohesion reduces the resistance to image transfer ascribable to the cohesion between the toner particles. The above occurrence was also proved by the fact that even the black toner obviated the vermicular omission when an additive added to the outer periphery of its particles was increased to reduce the degree of cohesion to about 15%. It follows that high image quality is achievable at all times if the black toner having a high degree of cohesion and the red toner having a low degree of cohesion are respectively stored in the upstream developing unit 18 and downstream developing unit 24, and if the second charger 5 is driven only when a monocolor black image is transferred to, e.g., a thick sheet.

While the above embodiment has concentrated on a bicolor image, it is similarly practicable with three or more different colors of toner.

The embodiment described above has the following unprecedented advantages.

(1) A multicolor image forming apparatus includes a charger, an exposing unit and a developing unit sequentially arranged in a plurality of sets in the direction of rotation of a photoconductive element. A monocolor or multicolor toner image is formed on the photoconductive element and then transferred to a sheet by a contact type transfer device. When a monocolor toner image is to be formed, the surface of the photoconductive element carrying the image is recharged by a downstream charger and then transferred to a sheet. This enhances an image transferring force at an image transfer position and thereby obviates the vermicular omission of images.

(2) When the photoconductive element carrying the monocolor toner image thereon is to be recharged, the downstream charger is provided with a condition different from a condition assigned to the formation of a multicolor image. Therefore, attractive images can be transferred to sheets of different thicknesses.

(3) When a manual feed mode for, e.g, thick sheets is selected or when a recharge mode select switch provided on an operation panel is operated, the photoconductive element carrying the monocolor toner image is recharged. This saves power and reduces ozone while insuring high image quality.

(4) Toner having a high degree of cohesion and toner having a low degree of cohesion are respectively stored in the upstream developing unit and downstream developing unit. Only when a monocolor image formed by the toner of high degree of cohesion is to be transferred to, e.g., a thick sheet, the photoconductive element is recharged. As a result, high image quality is achievable at all times without resorting to an exclusive charger for recharging the photoconductive drum.

Figure 3:
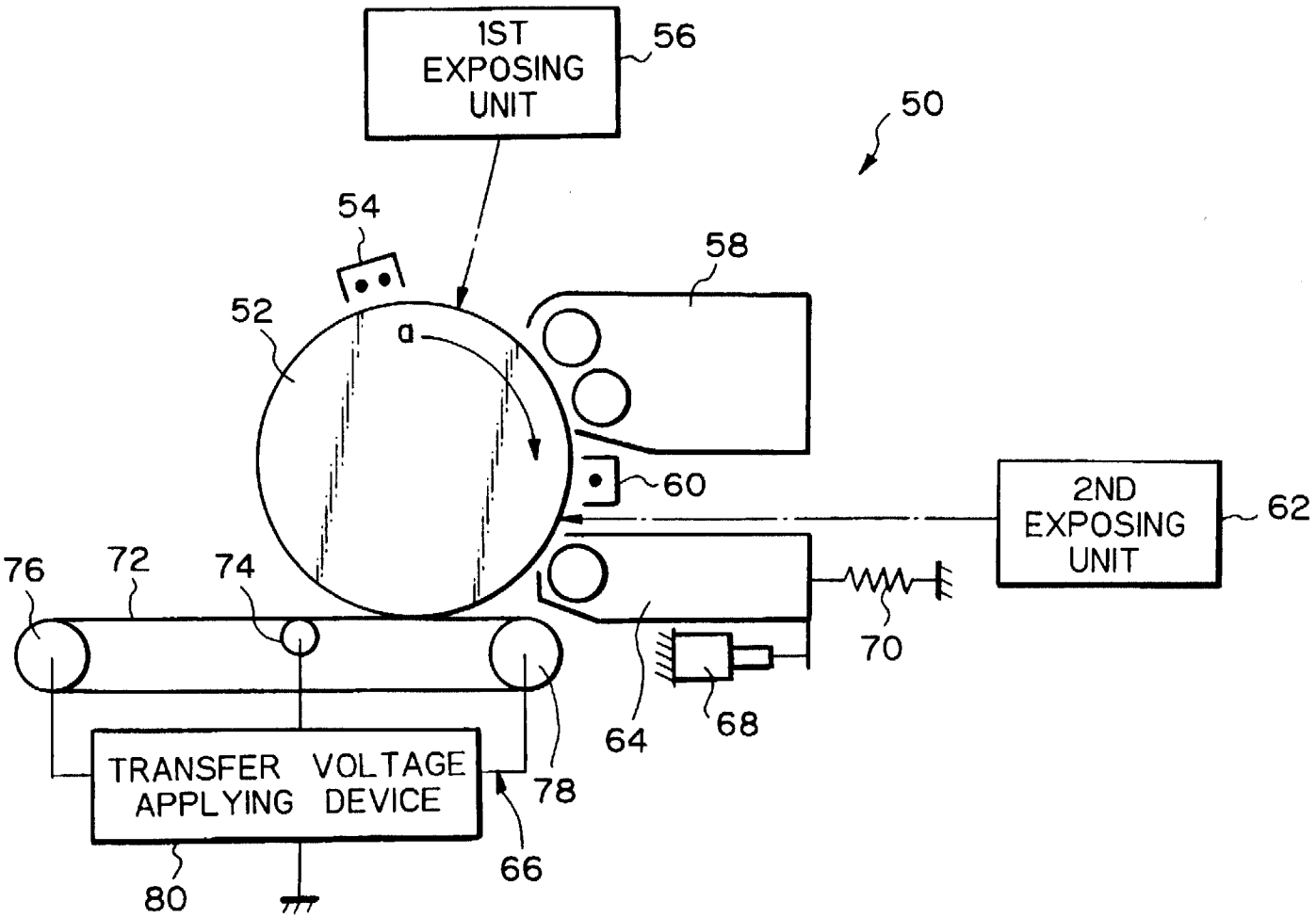
FIG. 3 shows an alternative embodiment of the present invention.

Referring to FIG. 3, an alternative embodiment of the present invention will be described. As shown, a multicolor image forming apparatus, generally 50, includes a photoconductive element in the form of a drum 52 rotatable in a direction indicated by an arrow a in FIG. 3. A first charger 54, a first exposing unit 56, a first developing unit 58, a second charger 60, a second exposing unit 62 and a second developing unit 64 are sequentially arranged in this order from the upstream side to the downstream side in the direction α. The units 54–58 constitute first image forming means while the units 60–64 constitute second image forming means. A contact type transfer device 66 is located downstream of the second developing unit 64.

Black toner and red toner are stored in the first and second developing units 58 and 64, respectively. A solenoid 68 and a spring 70 are connected to the second developing unit 64. Only during development, the developing unit 64 is brought to a position close to the drum 52 by the solenoid 68. While development is not under way, the developing unit 64 is moved away from the drum 52 by the spring 70.

The contact type transfer device 66 includes a belt 72 passed over a drive roller 76 and a driven roller 78. The belt 72 is held in pressing contact with the drum 52. A bias roller 74 is held in contact with the rear of the upper run of the belt 72. A transfer voltage applying device 80 is connected to the bias roller 74 in order to apply a bias voltage for image transfer.

Figure 4:
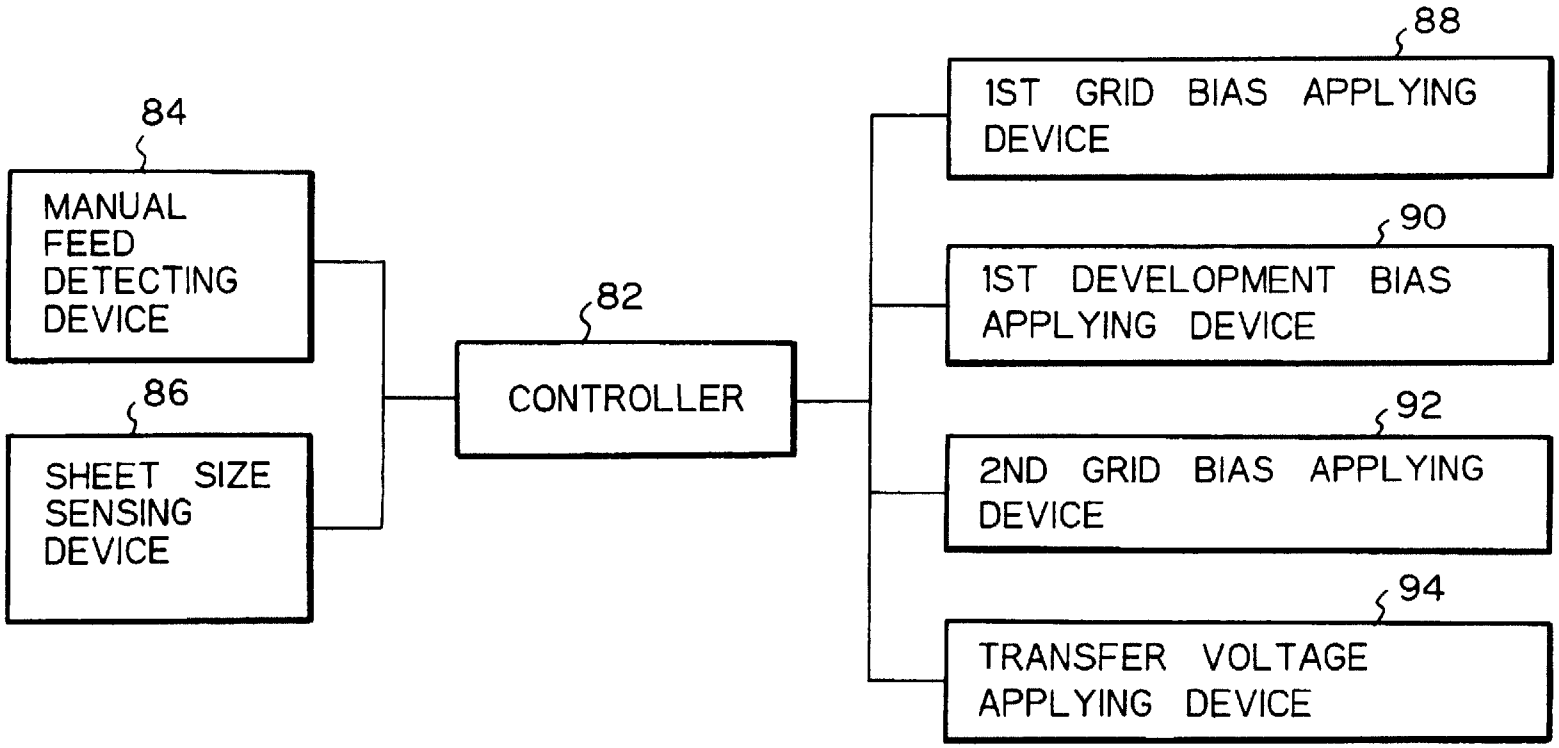
FIG. 4 is a block diagram schematically showing a control system included in the alternative embodiment.

FIG. 4 shows a control system included in the illustrative embodiment. As shown, the system includes a controller 82 for outputting various kinds of control signals in response to various kinds of input data. A manual feed detecting device 84 and a sheet size sensing device 86 are connected to the corresponding inputs of the controller 82. The manual feed detecting device 84 detects the selection of manual sheet feed while the sheet size sensing device 86 senses the size of sheets to be fed. A first grid bias applying device 88, a first development bias applying device 90, a second grid bias applying device 92 and a transfer voltage applying device 94 are connected to the corresponding outputs of the controller 82. The first and second grid bias applying devices 88 and 92 apply grid biases to the first and second chargers 54 and 60, respectively. The first development bias applying device 90 applies a bias for development to the first developing unit 58 while the transfer voltage applying device 94 applies a voltage to the transfer voltage applying device 80.

The apparatus 50 further includes first, second and third image forming condition control means. The first image forming condition control means reduces the amount of toner to deposit on the drum 52 during development. The second image forming condition control means causes the second charger 60 to recharge, before transfer, a toner image formed on the drum 52 by the first image forming means. The third image forming condition control means varies a transfer difference current to flow from the transfer device 66 to the drum 52. The first to third control means are implemented as processing for controlling the applying devices 88, 90, 92 and 94 on the basis of the data input to the controller 82. The first to third control means are selectively executed. The transfer difference current mentioned above refers to a difference between the total current fed to the transfer device 66 and a current fed back via the drive roller 76 and driven roller 78, i.e., a current to flow to the drum 52.

Specifically, the first image forming condition control means adjusts a charge potential and a bias for development at the same time so as to reduce a potential difference in an image area without varying a potential difference in a non-image area, thereby reducing the amount of toner to deposit on the drum 52. When the second image forming condition control means recharges a toner image, the charge voltage of the second charger 60 is selected to be lower than a charge voltage for the second image forming means, including the charger 60, to form an image.

With the above arrangement, the apparatus 50 is capable of selectively forming a black-and-red bicolor image or a black or red monocolor image, as follows. First, in a bicolor mode, the first charger 54 charges the surface of the drum 52 uniformly. The first exposing unit 56 exposes the charged surface of the drum 52 in order to form a negative-to-positive latent image. The first developing unit 58 develops the latent image with the black toner, forming a black toner image.

Subsequently, the second charger 60 recharges the surface of the drum 52, i.e., both the image area and the non-image area. Then, the second exposing unit 62 exposes the surface of the drum 52 in order to form a negative-to-positive latent image. The second developing unit 64 develops the latent image with the red toner so as to transform it to a red toner image.

A sheet is fed to the belt 72 in synchronism with the formation of the red toner image and conveyed by the belt 72. The transfer voltage applying device 80 applies a transfer voltage to the transfer device 66 with the result that the black-and-red toner image is transferred from the drum 52 to the sheet. At this instant, the transfer difference current to flow to the drum 52 is maintained constant. Therefore, stable image transfer is insured although the electrical characteristic of the belt 72 may be slightly irregular.

The prerequisite with the second charger 60 in the bicolor mode is that it prevents the red toner from being mixed with the black toner image and prevents the black toner from entering the second developing unit 64. In the illustrative embodiment, the first image forming means forms a black toner image with a charge potential (first grid bias) of −850 V applied to the first charger 54, a potential (first exposure potential) of −100 V applied to the first exposing unit 56, and a development bias of −550 V applied to the first developing unit 58. On the other hand, the second image forming means forms a red toner image with a charge potential (second grid bias) of −900 V applied to the second charger 60, a potential (second exposure potential) of −100 V applied to the second exposing unit 62, and a development bias of −750 V applied to the second developing unit 64. This allows the black toner image to be recharged by a potential of −800 V to −900 V.

As for a black monocolor mode, experiments were conducted by varying the first grid bias, bias for development, second grid bias, and transfer difference current. The resulting images were evaluated as to the vermicular omission and massive omission. For the experiments, the first exposure potential was fixed at −100 V, and use was made of 55K sheets of size A3, 135K sheets of size A3, OHP (Over Head Projector) sheets, and post cards. The 55K sheets and 135K sheets were fed in their vertically long positions. Table 1 shown below lists the results of the experiments.

TABLE 1

| | Vermicular/Massive | | | | | | | | | |
|---|---|---|---|---|---|---|---|---|---|---|
| | Image Forming Condition | | | | | | Kind of Sheet | | | |
| | 2nd Charger | 2nd Grid Bias (-V) | 1st Grid Bias (-V) | 1st Exposure Potential (-V) | 1st Development Bias (-V) | Transfer Difference Current (μA) | 55K Sheet | 135K Sheet | OHP Sheet | Postcard |
| ① | OFF | — | 890 | 100 | 550 | 50 | ◎/○ | X/○ | X/○ | X/○ |
| ② | OFF | — | 890 | 100 | 350 | 50 | ◎/○ | ○/○ | X/○ | X/○ |
| ③ | OFF | — | 670 | 100 | 350 | 50 | ◎/○ | ◎/○ | X/○ | X/○ |
| ④ | OFF | — | 890 | 100 | 550 | 70 | ◎/○ | X/○ | X/○ | X/○ |
| ⑤ | OFF | — | 890 | 100 | 350 | 70 | ◎/○ | ○/○ | X/○ | X/○ |
| ⑥ | OFF | — | 670 | 100 | 350 | 70 | ◎/○ | ◎/○ | ○/○ | Δ/○ |
| ⑦ | ON | 900 | 890 | 100 | 550 | 50 | ◎/○ | ○/○ | Δ/○ | Δ/○ |
| ⑧ | ON | 900 | 890 | 100 | 350 | 50 | ◎/X | ○/X | Δ/○ | Δ/○ |
| ⑨ | ON | 900 | 670 | 100 | 350 | 50 | ◎/X | ◎/X | ○/X | ○/X |
| ⑩ | ON | 900 | 890 | 100 | 550 | 70 | ◎/○ | ○/○ | Δ/○ | Δ/○ |
| ⑪ | ON | 900 | 890 | 100 | 350 | 70 | ◎/X | ○/X | Δ/X | Δ/X |
| ⑫ | ON | 900 | 670 | 100 | 350 | 70 | ◎/X | ◎/X | ◎/X | ◎/X |
| ⑬ | ON | 1050 | 890 | 100 | 550 | 50 | ◎/X | ◎/X | ○/X | ○/X |
| ⑭ | ON | 1050 | 890 | 100 | 350 | 50 | ◎/X | ◎/X | ◎/X | ◎/X |
| ⑮ | ON | 1050 | 670 | 100 | 350 | 50 | ◎/X | ◎/X | ◎/X | ◎/X |
| ⑯ | ON | 1050 | 890 | 100 | 550 | 70 | ◎/X | ◎/X | ○/X | ○/X |
| ⑰ | ON | 1050 | 890 | 100 | 350 | 70 | ◎/X | ◎/X | ◎/X | ◎/X |
| ⑱ | ON | 1050 | 670 | 100 | 350 | 70 | ◎/X | ◎/X | ◎/X | ◎/X |
| ⑲ | ON | 700 | 890 | 100 | 550 | 50 | ◎/○ | Δ/○ | X/○ | X/○ |
| ⑳ | ON | 700 | 890 | 100 | 350 | 50 | ◎/○ | ○/○ | Δ/○ | Δ/○ |
| ㉑ | ON | 700 | 670 | 100 | 350 | 50 | ◎/○ | ◎/○ | Δ/○ | Δ/○ |
| ㉒ | ON | 700 | 890 | 100 | 550 | 70 | ◎/○ | Δ/○ | X/○ | X/○ |
| ㉓ | ON | 700 | 890 | 100 | 350 | 70 | ◎/○ | ○/○ | Δ/○ | Δ/○ |
| ㉔ | ON | 700 | 670 | 100 | 350 | 70 | ◎/○ | ◎/○ | ◎/○ | ◎/○ |

In Table 1, double circles show that neither the vermicular omission nor the massive omission occurred while circles show that the vermicular omission and massive omission occurred when looked at closely. Triangles show that the vermicular omission and massive omission occurred, but were acceptable in practice, while crosses show that the vermicular omission and massive omission were conspicuous.

As Table 1 indicates, the vermicular omission increases with the increase in the thickness and elasticity of sheets, i.e., when the thick sheets (135K), OHP sheets and postcards are used. It is possible to obviate the vermicular omission by lowering the first bias for development in order to reduce the amount of toner, by applying the second charge, or by increasing the transfer difference current.

However, when the first bias for development is simply lowered to reduce the amount of toner, it is likely that characters suffer from the vermicular omission because they are enhanced due to an edge electric field. Should the first bias be further lowered in order to free characters from the vermicular omission, the density of a solid image (solid image density) lacking the edge electric field would be critically lowered. When the second charge is simply applied, it should be applied excessively in order to avoid locally omitted images; the massive omission occurs due to discharge at the inlet of the image transfer position. This is also true when the transfer current is simply increased.

In the illustrative embodiment, the first bias for development is lowered, and in addition the first grid bias is lowered. In this condition, while a difference between the first bias and the surface potential of the non-image area (non-image area potential difference) is not varied, a difference between the first bias and the potential of the image area (image area potential difference) is reduced. This successfully reduces the enhancement ascribable to the edge electric field and thereby reduces the amount of toner to deposit on the drum 52 (execution of the first image forming condition control means). Alternatively, an adequate second charge is applied (execution of the second image forming condition control means), or the transfer difference current is increased (execution of the third image forming condition control means). With any one of such control means, it is possible to obviate the vermicular omission while obviating the massive omission.

Table 2 shown below lists three different image forming conditions A, B and C particular to the embodiment and available for forming a black monocolor image, and a usual image forming condition. Such image forming conditions are selected depending on whether or not the manual feed stage is selected and whether or not the sheet size, labeled W, is smaller than size A5 positioned vertically long or whether it is smaller than size A4 positioned vertically long.

TABLE 2

| | A | B | C | Usual |
|---|---|---|---|---|
| Feed Stage Selection Condition | Manual | Manual | Manual | Automatic |
| Sheet Size (W) Condition | A5T≧W | A4T≧W>A5T | W>A4T | — |
| Transfer Difference Current (μA) | 70 | 70 | 50 | 50 |
| 1st Grid Bias (-V) | 670 | 670 | 670 | 890 |
| 1st Development Bias (-V) | 350 | 350 | 350 | 550 |
| 2nd Charger 60 | ON | OFF | OFF | OFF |
| 2nd Grid Bias (-V) | 700 | — | — | — |

The above condition A means that the first, second and third image forming condition control means are executed. The first control means controls the first grid bias and first bias for development to −670 V and −350 V, respectively. The second control means controls the second grid bias to −700 V. The third control means increases the transfer difference current to 70 μA. The condition A is identical with the condition assigned to sample #24 shown in Table 1.

The condition B means that the first and third image forming condition control means are executed. The first control means controls the first grid bias to −670 V and the first bias for development to −350 V. The third control means increases the transfer difference current to 70 μA. The condition B is identical with the condition assigned to sample #6 shown in Table 1.

The condition C means that only the first image forming condition control means is executed. The first control means controls the first grid bias and first bias for development to −670 V and −350 V, respectively. The condition C is identical with the condition assigned to sample #3 shown in Table 1.

The usual condition means that none of the first to third image forming condition control means is executed, and is identical with sample #1 shown in Table 1.

Figure 5:
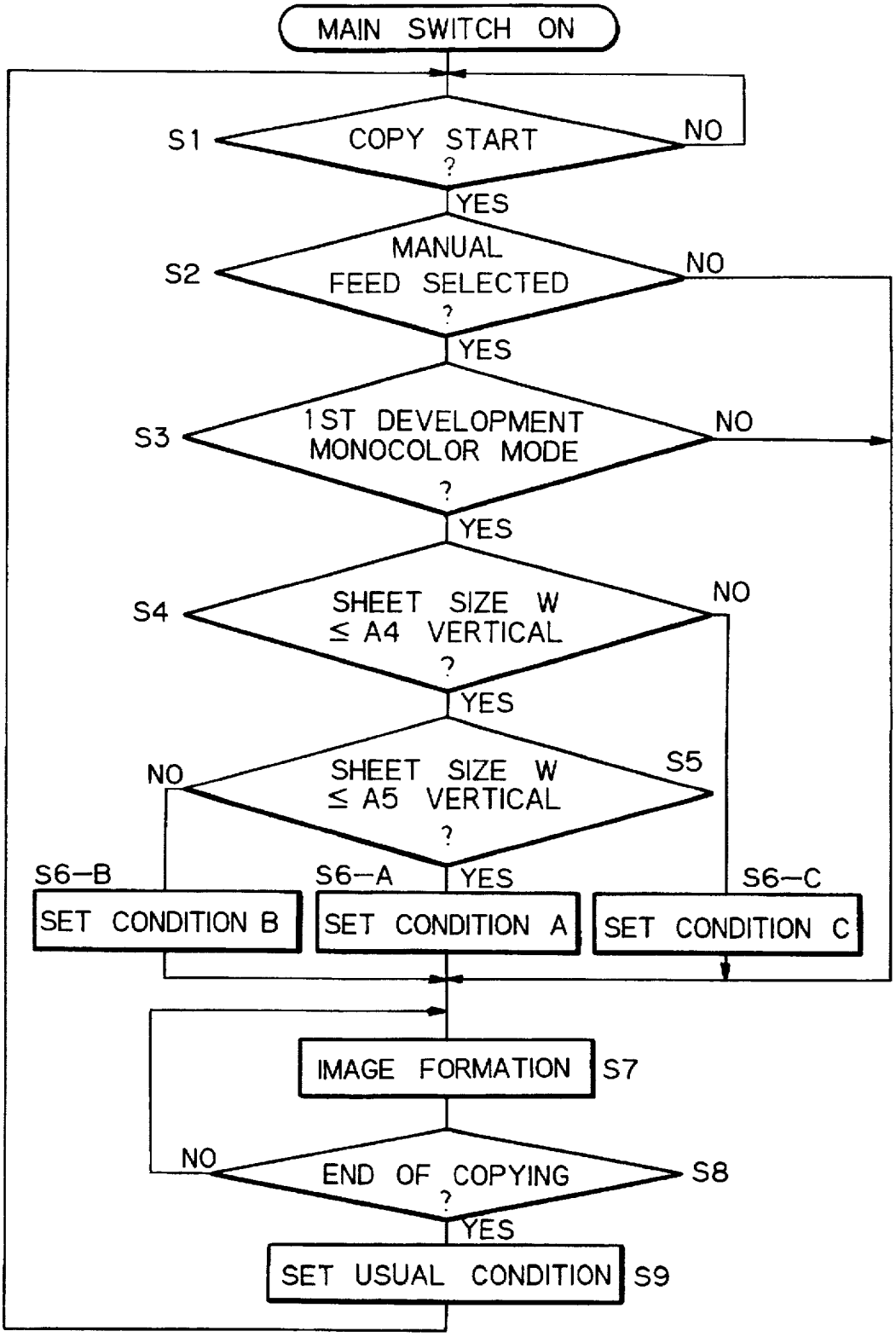
FIG. 5 is a flowchart representative of an algorithm for forming a black monocolor image in the alternative embodiment.

The algorithm for forming a black monocolor image in accordance with the conditions listed in Table 2 will be described with reference to FIG. 5. As shown, when a main switch is turned on, whether or not a copy start command is input is determined (step S1). If the answer of the step S1 is positive (Y), whether or not the manual feed stage is selected is determined (step S2). If the answer of the step S2 is negative (N), image formation is executed under the usual condition already set up (step S7). When the image formation ends (Y, step S8), the usual condition is maintained (step S9).

If the manual feed stage is selected (Y, step S2), whether or not a first development monocolor mode (black monocolor mode) is selected (step S3). If the answer of the step S3 is N, image formation is effected under the usual mode already set up (step S7). When the image formation ends (Y, step S8), the usual condition is maintained (step S9).

If the answer of the step S3 is Y, whether or not the sheet size W is smaller than or equal to size A4 positioned vertically long is determined (step S4). If the answer of the step S4 is N, the image forming condition C is set up (step S6-C), and then image formation is executed (step S7). When the image formation ends, the condition C is replaced with the usual condition (step S9).

If the sheet size W is smaller than or equal to size A4 positioned vertically long (Y, step S4), whether the size W is smaller than or equal to size A5 positioned vertically long is determined (step S5). If the answer of the step S5 is N, the image forming condition B is set up (step S6-B), and then image formation is executed (step S7). When the image formation ends (Y, step S8), the condition B is replaced with the usual condition (step S9).

If the sheet size W is equal to or smaller than size A5 positioned vertically long (Y, step S5), the image forming condition A is set up (step S6-A), and image formation is executed (step S7). When the image formation ends (Y, step S8), the condition A is replaced with the usual condition (step S9).

Why the three different conditions A, B and C are selectively set up in response to the selection of the manual feed stage and sheet size is as follows. Thick sheets which are apt to bring about the vermicular omission are fed by hand more often than by an automatic mechanism. In addition, such sheets are, in many cases, smaller than size A4 or A5 positioned vertically long.

Only when OHP sheets, postcards or similar sheets smaller than size A4 positioned vertically long and apt to result in locally omitted images are used, the transfer difference current is increased. This successfully promotes power saving. Further, only when use is made of postcards or similar sheets smaller than size A5 and more likely to result in the vermicular omission, the second charger 5 is driven. This not only saves power but also reduces ozone.

In the embodiment, the image forming condition is switched on the basis of the selection of the manual feed stage and the sheet size. Alternatively, a thick mode key, OHP sheet mode key, postcard mode key and other suitable keys may be provided on the operation panel and selectively operated by the user. Such keys serve to obviate the vermicular omission even when thick sheets of irregular sizes are used.

While the embodiment includes the first, second and third image forming condition control means, the third control means may be omitted, in which case the first and second control means will be selectively executed.

As stated above, the alternative embodiment of the present invention has the following unprecedented advantages.

(1) First image forming condition control means reduces the amount of toner to deposit on a photoconductive drum, and therefore the amount of toner to deposit on character images. This reduces the fall of a transfer electric field ascribable to a toner layer. After upstream image forming means with respect to the direction of rotation of the drum has formed a toner image on the drum, second image forming condition control means recharges the toner image before transfer by use of a charger included in downstream image forming means. This increases the amount of charge to deposit on the toner image without resorting to any extra device. Third image forming condition control means increases a voltage or a current to be applied to a contact type transfer device, thereby enhancing desirable transfer of the toner image. The first to third control means are selectively executed to obviate the vermicular omission of images without resorting to any extra device.

(2) The first control means adjusts a charge potential and a bias for development at the same time in order to reduce the potential difference of an image area without varying the potential difference of a non-image area. Therefore, the amount of toner for development can be reduced while restricting the enhanced development of characters ascribable to an edge electric field. This obviates the vermicular omission of images while causing the density of a solid image to fall little.

(3) The second control means sets a lower charge voltage in a charger at the time of recharge than when the image forming means including the charger forms an image. This obviates the vermicular omission while obviating the massive omission ascribable to the excessive recharge of the toner image.

(4) The third control means varies a transfer difference current to flow from a contact type transfer device to the drum. When the current is increased, the transfer of the toner image from the drum to a sheet is promoted, obviating the vermicular omission of images.

(5) The first to third control means are selectively executed when a manual feed stage is selected. Sheets to be fed via the manual feed stage are apt to result in locally omitted images. Therefore, the control means surely prevent images formed on such sheets from suffering from the vermicular omission.

(6) The first to third control means are selectively executed when sheets are of particular size, as determined by sheet size sensing means. Therefore, when postcards, OHP sheets or similar thick sheets and apt to bring about the vermicular omission are used, the first to third control means are selectively executed to surely avoid the vermicular omission.

Various modifications will become possible for those skilled in the art after receiving the teachings of the present disclosure without departing from the scope thereof.

What is claimed is:

1. An image forming apparatus comprising:

a plurality of chargers sequentially arranged in a direction of rotation of a photoconductive element, each for charging said photoconductive element;

a plurality of developing units sequentially arranged in said direction, each for forming a toner image of particular color on said photoconductive element;

a contact type transfer device for transferring the toner image from said photoconductive element to a recording medium; and control means for selectively operating said plurality of chargers and said plurality of developing units to thereby form either a monocolor toner image or a multicolor toner image on said photoconductive element, and for causing, when the monocolor toner image is to be formed, a downstream one of said plurality of chargers in said direction to recharge, before transfer by said transfer device, the toner image formed by an upstream one of said plurality of chargers in said direction and an upstream one of said plurality of developing units in said direction.

2. An apparatus as claimed in claim 1, wherein the upstream developing unit stores toner having a higher degree of cohesion than toner stored in the downstream developing unit.

3. An apparatus as claimed in claim 2, wherein said upstream developing unit stores black toner while said downstream developing unit stores toner of color other than black.

4. An apparatus as claimed in claim 1, wherein when the downstream charger recharges the toner image, a voltage different from a voltage for forming the multicolor toner image is applied to said downstream charger.

5. An apparatus as claimed in claim 4, wherein said voltage applied to said downstream charger for recharging is higher than the voltage for forming the multicolor toner image.

6. An apparatus as claimed in claim 1, wherein the recording medium is either a plain sheet or a thick sheet, and wherein said control means causes the downstream charger to recharge the monocolor toner image when the thick sheet is used.

7. An apparatus as claimed in claim 1, further comprising manual feed means for allowing an operator to feed a recording medium of any size or of any kind by hand, wherein said control means causes the downstream charger to recharge the monocolor image when the recording medium is fed by hand via said manual feed means.

8. An apparatus as claimed in claim 1, further comprising mode selecting means for allowing an operator to select a mode for causing the downstream charger to recharge the toner image formed on said photoconductive element.

9. An image forming apparatus comprising:

a plurality of chargers sequentially arranged in a direction of rotation of a photoconductive element, each for charging said photoconductive element;

a plurality of developing units sequentially arranged in said direction, each for forming a toner image of particular color on said photoconductive element;

a contact type transfer device for transferring the toner image from said photoconductive element to a recording medium; and a controller for selectively operating said plurality of chargers and said plurality of developing units to thereby form either a monocolor toner image or a multicolor toner image on said photoconductive element;

said controller comprising a first image forming condition control means for reducing an amount of toner for development, and a second image forming condition control means for causing, before transfer by said transfer device, a downstream one of said plurality of chargers in said direction to recharge a toner image formed by an upstream one of said plurality of chargers in said direction and an upstream one of said plurality of developing units in said direction;

wherein when the monocolor toner image is to be formed, said first and second image forming condition control means are selectively executed.

10. An apparatus as claimed in claim 9, wherein said first image forming condition control means adjusts a charge potential and a bias for development such that a potential difference of an image area decreases, but a potential difference of a non-image area does not vary.

11. An apparatus as claimed in claim 9, wherein said second image forming condition control means applies a lower charge voltage to the downstream charger at a time of recharging than when image forming means including said downstream charger forms a toner image.

12. An apparatus as claimed in claim 11, wherein said first image forming condition control means adjusts a charge potential and a bias for development such that a potential difference of an image area decreases, but a potential difference of a non-image area does not vary.

13. An apparatus as claimed in claim 9, wherein said first and second image forming condition control means are selectively executed when a manual feed stage for manual sheet feed is selected.

14. An apparatus as claimed in claim 9, further comprising sheet size sensing means for sensing a size of a sheet fed, wherein said first and second image forming condition control means are selectively executed when said size sensing means senses a particular size.

15. An apparatus as claimed in claim 9, wherein said controller further comprises a third image forming condition control means for controlling a voltage or a current to be applied to said transfer device, and wherein said first, second and third image forming condition control means are selectively executed when the monocolor toner image is to be formed.

16. An apparatus as claimed in claim 15, wherein said second image forming condition control mean applies a lower charge voltage to the downstream charger at a time of recharging than when image forming means including said downstream charger forms a toner image.

17. An apparatus as claimed in claim 15, wherein said third image forming condition control means varies a transfer difference current to flow from said transfer device to said photoconductive element.

18. An apparatus as claimed in claim 15, wherein said first and second image forming condition control means are selectively executed when a manual feed stage for manual sheet feed is selected.

19. An apparatus as claimed in claim 15, further comprising sheet size sensing means for sensing a size of a sheet fed, wherein said first and second image forming condition control means are selectively executed when said size sensing means senses a particular size.

* * * * *